United States Patent [19]

DaCosta

[11] Patent Number: 5,038,974

[45] Date of Patent: Aug. 13, 1991

[54] COMBINED FOOD CONTAINER AND DISPENSER

[76] Inventor: Harry DaCosta, 5925 Foothills Dr. N., Paradise Valley, Ariz. 85253

[21] Appl. No.: 563,868

[22] Filed: Aug. 6, 1990

Related U.S. Application Data

[63] Continuation-in-part of Ser. No. 393,250, Aug. 14, 1989, abandoned.

[51] Int. Cl.[5] ..... B65D 35/18

[52] U.S. Cl. ..... 222/106; 30/123.3

[58] Field of Search ..... 222/106, 103, 107; 30/123.3; 426/115

[56] References Cited

U.S. PATENT DOCUMENTS

| | | | |
|---|---|---|---|
| 2,600,631 | 6/1952 | Freedman | 222/103 |
| 2,841,310 | 7/1958 | Graber | 222/103 |
| 3,116,152 | 12/1963 | Smith | 30/123.3 |
| 3,154,418 | 10/1964 | Lovell et al. | 426/115 |
| 4,830,222 | 5/1989 | Read | 222/106 |

*Primary Examiner*—Robert P. Olszewski
*Assistant Examiner*—Kenneth Noland

[57] ABSTRACT

A disposable combined container and feeding spoon comprising a boat shaped handle portion formed integrally with a spoon portion the latter of which has a bowl. The handle portion is adapted to receive a plastic bag containing a predetermined quantity of non-solid food that is held in place within the handle portion. The handle portion includes flange members which retain a plate member the latter of which is used for providing downward pressure onto the bag during use to force the food to be dispensed from the bag into the bowl of the spoon.

11 Claims, 1 Drawing Sheet

COMBINED FOOD CONTAINER AND DISPENSER

This application is a continuation-in-part of prior application Ser. No. 07/393,250, filed Aug. 14, 1989, now abandoned.

BACKGROUND OF THE INVENTION

The present invention relates to food containers and dispensers and, more particularly, to a combination food container and feeding spoon for dispensing a non-solid food.

The most common application for the present invention is for the use of containing and dispensing baby food although it is appreciated that other uses for the invention to be described herein may be made. Most baby foods for the "infant" and "junior" categories are packaged in glass bottles which have removable lids. There are several disadvantages to the contemporary method of marketing and the packaging of baby foods. First, the bottles typically weigh at least six ounces which is not too heavy when only one or two bottles are purchased. However, typically dozens of such bottles are purchased at one time to maintain adequate supply. The individual weights of each bottle add up and can amount to several pounds which must be carried from the grocery store to the home. Moreover, the physical size of storing many baby food bottles requires unnecessary cupboard space and the bottles do not stack very neatly. In addition, the contents of the jars or bottles are usually more than can be consumed by an infant at any one meal which means that the jars have to be refrigerated for further use. Further, the jars typically have to be heated or warmed for feeding and care must be taken to ensure that the contents are not overheated to prevent discomfort or burning of the infant.

Yet another disadvantage of the packaging of baby food in bottles is that the contents have to be removed from the jar for feeding. In most cases the parent removes the contents of the jar with a spoon while feeding the infant and holding the jar. This can cause problems as it may be difficult to control the infant during feeding while holding the jar in one hand and the spoon in the other hand. Any parent who has contended with feeding a normal active child is aware of the many inherent disadvantages of the use of baby food jars.

There is at least one patent to Read, U.S. Pat. No. 4,830,222, which illustrates a combined container and spoon assembly for eliminating the disadvantages inherent in the use of baby food jars. The Read patent discloses a combined disposable food container and spoon device which includes a collapsible envelope portion for containing a predetermined quantity of non-solid food. A substantially rigid spoon portion having a bowl is formed with an elongated handle which extends the length of the envelope portion. The handle is bonded to the envelope to form the composite container and spoon assembly with one end of the envelope being adjacent to the bowl of the spoon. The end of the envelope adjacent the spoon bowl is severable such that when opened, the food in the envelope may be squeezed out through this opening into the bowl in controlled quantities.

Although the Read patent provides a good solution to the inherent disadvantages of glass jars it also suffers from several disadvantages which are desirable to overcome. In order to be able to squeeze out the contents of the envelope the combined handle and spoon assembly must be significantly longer than the palm of ones hand in order to be able to use ones thumb, for instance, to slide along the envelope to push the contents out the open end thereof. While moving the thumb the handle has to be continuously moved through the hand which due to the length of the combined assembly can make it difficult to get the spoon portion of the assembly into the infant's mouth without creating a messing situation.

It is therefore desirable to provide a combination disposable food container and dispenser, particularly suited for dispensing baby food, that is not subject to the disadvantages of the prior art.

SUMMARY OF THE INVENTION

Accordingly, it is an object of the present invention to provide an improved combined food container and dispenser assembly.

It is another object of the invention to provide an improved food container and spoon assembly for ease of feeding.

Yet another object of the present invention is to provide a disposable food container and spoon assembly in combination suited to feeding infants.

In accordance with the above and other objects there is provided a combined food container and spoon device comprising a boat shaped handle portion formed integrally with a spoon portion the latter of which has a bowl. The handle portion is adapted to receive a plastic bag containing a predetermined quantity of non-solid food that is held in place within the handle portion. A squeeze plate, which is retained in the handle portion above the bag, provides a means for depressing the bag by applying equal longitudinal downward pressure on the bag when pressed to force the food to be dispensed from the bag into the bowl of the spoon.

DETAILED DESCRIPTION OF THE PREFERRED EMBODIMENT

Figure 1:
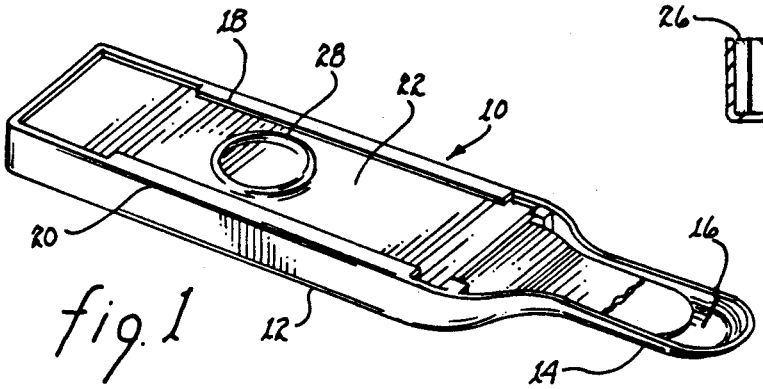
FIG. 1 is a perspective view of the combination container and food dispenser of the preferred embodiment.
Figure 4:
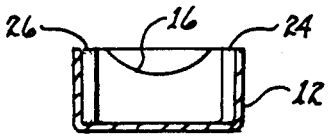
FIG. 4 is a cross sectional view of the dispenser of FIG. 1 taken along the lines of arrows 4—4.
Figure 2:
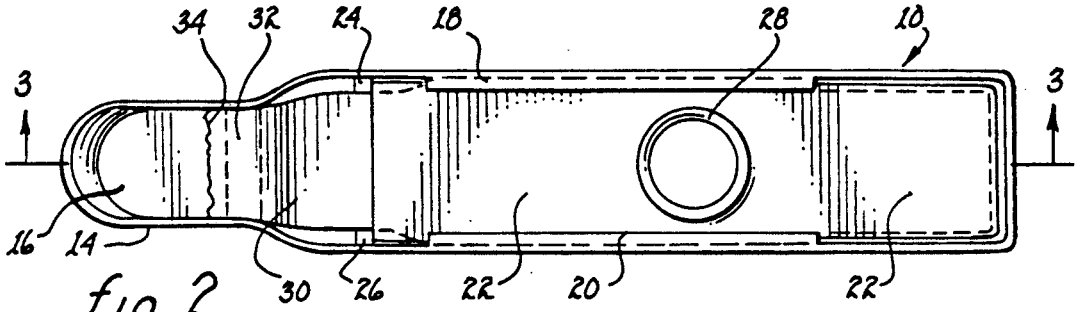
FIG. 2 is a top plan view of the dispenser of FIG. 1.
Figure 3:
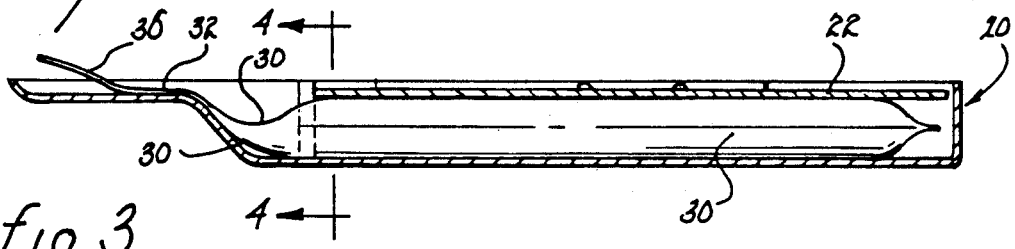
FIG. 3 is a cross sectional view of the dispenser of the invention taken along the lines of arrows 3—3.
Figure 5:
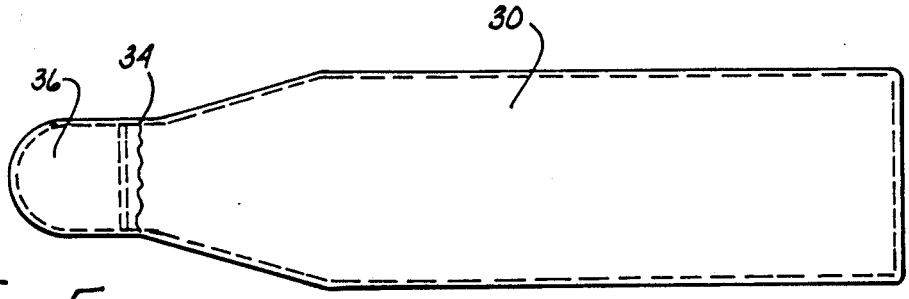
FIG. 5 is a top view of the plastic container bag of the invention.

Turning now to the Figures in which the same components are designated by the same reference numbers there is illustrated the combination food container and dispenser of the present invention. As shown, container and food dispenser 10 includes a handle and container portion 12 and spoon portion 14 having a bowl 16. In the preferred embodiment handle and spoon portions 12 and 14 are unitary constructed forming a unibody means of dispensing food that is contained within handle portion 12. Handle portion 12 is manufactured in a boat configuration of predetermined length, width and depth and is formed with longitudinal flange members 18 and 20 about the top edge. Dispenser 10 may be of any suitable material which can be fabricated by extrusion processes, for example polyvinyl chloride (PVC) plastic and is typically 0.030 inches thick. Boat shaped handle portion 12 provides substantial longitudinal rigidity to be used as the handle of the spoon portion 14 after complete assembly while at the same time is flexible enough during assembly to allow squeeze plate or depression member 22 to be assembled onto the handle portion with flange members 18 and 20 holding the plunger in place during use of dispenser 10. As illustrated in FIG. 4 (showing dispenser 10 sans squeeze plate 22), stops 24 and 26 are formed as part of handle portion 12 to prevent movement of squeeze plate 22 in the forward longitudinal direction after assembly. Squeeze plate 22, which may also be formed of PVC, has slightly smaller dimensions than handle portion 12 and includes a finger depression well formed by the slightly raised ring member 28 located at the center of pressure of the handle portion so that when depressed does not provide any unbalancing forces to dispenser 10. Squeeze plate 22 is rectangular shaped.

When assembled, squeeze plate 22 rests under flange member 18 and 20 and atop bag 30 the latter, which when filled helps retain the plate in the assembly. Plastic bag 30 is disposed in boat shaped handle portion 12 and is bonded in place, for example, at site 32 adjacent to spoon portion 14 using suitable sticky tape or glue. Bonding or glue site 32 holds the opening end or exit canal of plastic bag in place such that the end is positioned with respect to spoon portion 14 to permit the food to be squeezed directly into bowl 16.

For baby food, a single serving portion of food is contained in bag 30 the latter of which is held within handle portion 12. After filled bag 30 is placed in handle portion 12, squeeze plate 22 is located within handle portion 12 and is thereafter fixedly retained in place by the assembly comprising flange members 18 and 20 and stops 24 and 26. Plastic bag 30 is filled so that its full volume is just less than the volume of handle portion 12 wherein after assembly bag 30 completely fills the handle portion. For instance, bag 30 may be similar to bags used to fill individual portions of condiments such as ketchup and mustard in individual envelopes. Plastic bag 30 has end opening 34 which is held in a closed state by serrated tear off tab 36 which once torn off allows food contained in bag 30 to be dispensed directly into bowl 16 of spoon portion 14. The concavity of spoon portion 14 is continued to handle portion 12 which ensures that end 34 opens after removal of tab 36.

Figure 6:
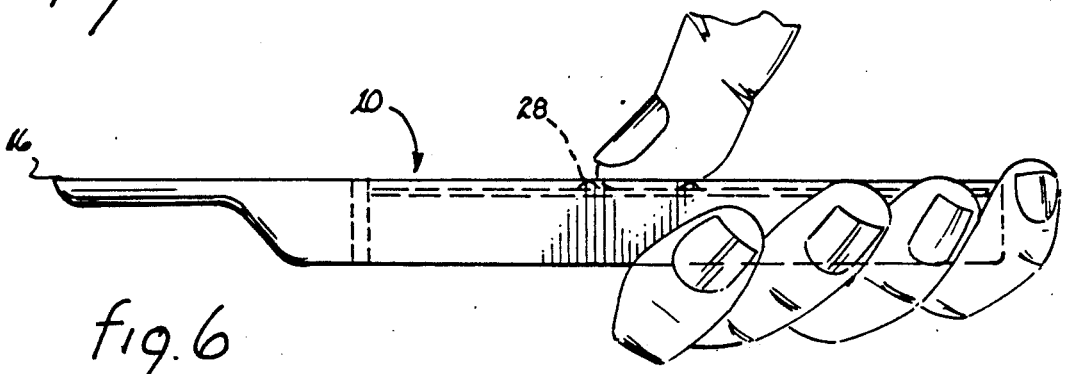
FIG. 6 is a perspective view of the present invention illustrating the use thereof.

To use dispenser 10, end 34 of plastic bag 30 is opened (after warming if necessary) by removing tab 36 to allow the food contained therein to be dispensed in spoon portion 14. Handle portion 12 is held in the palm of the hand and the fingers with the thumb located in depression formed by ring 28 as illustrated in FIG. 6. A squeezing pressure applied against squeeze plate 22 by the thumb causes equal pressure to be forced longitudinally against bag 30 to force the food contained therein out of the open end thereof into the bowl 16 of spoon portion 14. When the desired quantity of food is dispensed into bowl 16, dispenser 10 is used in the manner of a conventional spoon to feed a baby or invalid. Moreover, as squeeze plate or depression member 22 is a rigid member, pressure is applied to bag 30 only when the user depresses the member by applying pressure between their thumb and palm to dispense the food contained therein; at all other times there is no pressure applied to bag 30 by member 22 wherein food will not flow from bag 30.

Dispenser 10 is approximately 1.0 inches wide narrowing to approximately 0.80 inches wide at the spoon portion 14. Flange members 18 and 20 may be approximately one-sixteenth inches wide. When assembled, combined food container and dispenser 10 weighs slightly more than the weight of the food contained in bag 30. In addition, the geometrical shape of dispenser 10 lends itself to multiple packaging and marketing as well as storing.

As briefly mentioned, most dispenser known require that the handle portion be continually moved through the user's hand in order to push or slide the food out of the food containing element. Hence, the dispenser must be awkwardly and continually moved while at the same time directed into the mouth of the infant or invalid. Needless to say, this can cause food to be dropped from the spoon or even smeared about the face of the infant. However, dispenser 10 of the present invention overcomes the foregoing disadvantages as it eliminates the necessity of having to be moved during feeding as it is held firmly in the hand and fingers of the user requiring only thumb pressure to be applied to one area of the handle portion. Thus, the length of the spoon portion projecting from the holding position does not change as in the case of the prior art. It is considered obvious from the above description that dispenser 10 may be modified by forming the dispenser without spoon portion 14 wherein dispenser 10 comprises only handle portion and container 12 in which bag 30 is disposed and rigid depression member 22 as previously described. In this manner, a severely handicapped person may be fed directly from bag 30 after tab 36 is removed.

Flange members 18 and 20 as well as end stops 24 and 26 can be eliminated if, for example, a pair of bonding or glue sites are provided in handle portion 12 to which bag 30 is held in place. In conjunction a pair of corresponding bonding sites would be placed on the underside of squeeze plate 22 to hold the squeeze plate fixedly in position, the sites' edges being the width of handle portion 12.

Hence, what has been described above is a novel combined food container and dispencer formed in an integral package. One novel aspect of the dispencer is that it can be held firmly in the palm of the hand and requires pressure to be placed at a signal spot along the handle portion thereof instead of a sliding pressure during the dispensing of food into the spoon portion of the dispencer.

What is claimed is:

1. A combined container and dispenser assembly, comprising:

a substantially rigid spoon portion with a bowl formed integrally to a rigid boat-shaped longitudinal handle portion wherein said handle portion includes side walls and inwardly facing flange members oppositely formed along a portion of the length of said side walls;

collapsible container means for containing a predetermined quantity of non-solid matter, said container means being of predetermined size to permit said container means to be disposed within said boat shaped handle portion, said container means having a narrowed end projection which extends to said bowl when said container means is disposed in said handle portion and which includes an openable end portion to permit dispensing of said matter in said bowl subsequent to being opened as said container means is compressed; and rigid depression means retained within said handle portion which extends longitudinally above said container means and further being held within said handle portion by said flange members, said depression means compressing said container means in response to pressure being applied thereto as said depression means is depressed to force said matter from said container means into said bowl only as said depression means is depressed by said pressure being applied thereto.

2. The combination of claim 1 including severable closing means for holding said end portion of said container means closed until severed therefrom after which said end portion becomes opened.

3. The combination of claim 2 wherein said width of said boat-shaped handle portion is less than its length and said spoon portion is narrower than said width of said handle portion.

4. The combination of claim 3 wherein said end projection of said containing means overlies a portion of said bowl of said spoon portion.

5. The combination of claim 1 wherein said containing means comprises a plastic bag having a narrowed end forming said end projection.

6. The combination of claim 1 wherein said depression means comprises a rigid member the length and width of which are narrower than the corresponding dimensions of said handle portion and having a raised ring at which a singular pressure force is applied to provide substantially equal longitudinal pressure against said containing means to cause depression of the latter.

7. A combined container and dispenser, comprising:

a rigid boat-shaped holder having extended longitudinal side walls, an end wall and an open end distal to said end wall, said longitudinal side walls having inwardly facing flanges formed along the top surface thereof and along a portion of the length thereof;

collapsible container means for containing a predetermined quantity of non-solid matter, said container means being of predetermined size to permit the same to be disposed within said holder and having a narrowed end portion which extends through said open end of said holder and which includes an openable end portion to permit dispensing of said matter therefrom subsequent to being opened and said container means being compressed; and a rigid plate member retained in said holder by said flanges in spatial relationship to said container means, said plate member being responsive to being depressed for applying pressure to said container means only while said plate member is depressed to force said matter from said container means.

8. The combination of claim 7 wherein said holder includes:

stop means formed at said open end of said holder, said flanges and said stop means retaining said plate member fixedly within said holder above said container means.

9. The combination of claim 8 wherein said container means comprises a plastic bag fully disposed within said holder and having a narrowed end forming said end projection thereof extending through said open end of said holder.

10. A combined container and dispenser assembly, comprising:

a rigid boat-shaped holder having extended side walls, an end wall and an open end distal to said end wall;

collapsible container means for containing a predetermined quantity of non-solid matter, said container means being of predetermined size to permit the same to be disposed within said holder and having a narrowed end portion which extends through said open end of said holder and which includes an openable end portion to permit dispensing of said matter therefrom subsequent to being opened and said container means being compressed;

a rigid plate member retained in said holder in spatial relationship to said container means, said plate member being responsive to being depressed for applying pressure to said container means only while said plate member is depressed for compressing said container means; and said longitudinal side walls having inwardly facing flange members formed along a portion of the length thereof and stop means retaining said plate member fixedly within said holder above said container means wherein said stop means includes a pair of posts formed integrally with said holder at the open end thereof.

11. The combination of claim 9 wherein said plate member includes a rigid member the length and width of which are sized to fit within said holder between said end wall and said pair of post and being retained by said flange members and having a raised ring portion extending outwardly thereof which is responsive to a singular pressure force being applied thereto to provide substantially equal longitudinal pressure to said container means.

* * * * *